US011674255B2

(12) United States Patent
Lee et al.

(10) Patent No.: US 11,674,255 B2
(45) Date of Patent: Jun. 13, 2023

(54) LAUNDRY TREATING APPARATUS AND METHOD FOR CONTROLLING THE SAME

(71) Applicant: LG Electronics Inc., Seoul (KR)

(72) Inventors: Kilryong Lee, Seoul (KR); Junyoung Kim, Seoul (KR); Taegyu Jang, Seoul (KR)

(73) Assignee: LG Electronics Inc., Seoul (KR)

( * ) Notice: Subject to any disclaimer, the term of this patent is extended or adjusted under 35 U.S.C. 154(b) by 109 days.

(21) Appl. No.: 16/775,492

(22) Filed: Jan. 29, 2020

(65) Prior Publication Data

US 2020/0248370 A1 Aug. 6, 2020

(30) Foreign Application Priority Data

Feb. 1, 2019 (KR) ..... 10-2019-0013839
Apr. 19, 2019 (KR) ..... 10-2019-0046077

(51) Int. Cl.
*D06F 37/22* (2006.01)
*D06F 33/40* (2020.01)
(Continued)

(52) U.S. Cl.
CPC ..... *D06F 37/22* (2013.01); *D06F 33/40* (2020.02); *D06F 39/083* (2013.01); *D06F 39/14* (2013.01); *D06F 2105/48* (2020.02)

(58) Field of Classification Search
CPC ..... D06F 33/48; D06F 33/76; D06F 34/08; D06F 34/16; D06F 37/20; D06F 37/22;
(Continued)

(56) References Cited

U.S. PATENT DOCUMENTS 5,860,300 A * 1/1999 Valent ..... D06F 37/266 68/210
9,637,855 B2 * 5/2017 Buso ..... D06F 39/14
(Continued)

FOREIGN PATENT DOCUMENTS

CN 104790173 7/2015
GB 2148953 6/1985
(Continued)

OTHER PUBLICATIONS

Extended European Search Report in European Application No. 20154875.7, dated Jun. 10, 2020, 9 pages.
(Continued)

*Primary Examiner* — David G Cormier
(74) *Attorney, Agent, or Firm* — Fish & Richardson P.C.

(57) ABSTRACT

A laundry treating apparatus includes a cabinet, a tub, a drum rotatably disposed inside the tub, an elastic member to connect, to the cabinet, a portion of the tub body above a horizontal line passing through a rotation center of the drum; first and second dampers to connect, to the cabinet, a portion of the tub body located below the horizontal line; and a third damper to connect, to the cabinet, a portion of the tub body located below the horizontal line. A first location is defined as one of left and right portions in the tub body relative to a vertical line passing through the rotation center of the drum, while a second location is defined as the other portion. The first damper and second damper are disposed at the first location. The third damper is disposed at the second location.

9 Claims, 6 Drawing Sheets

(51) Int. Cl.
*D06F 39/14* (2006.01)
*D06F 39/08* (2006.01)
*D06F 105/48* (2020.01)

(58) Field of Classification Search
CPC .. D06F 37/265; D06F 37/268; D06F 2103/26; D06F 2103/46
See application file for complete search history.

(56) References Cited

U.S. PATENT DOCUMENTS

2005/0108830 A1* 5/2005 Park ..... D06F 33/40 8/158
2005/0217323 A1* 10/2005 Lee ..... D06F 37/20 68/23.1
2006/0174665 A1* 8/2006 Namkung ..... D06F 37/206 68/140
2012/0151972 A1* 6/2012 Jung ..... D06F 37/22 68/5 C
2014/0007626 A1* 1/2014 Hwang ..... D06F 37/265 68/23.2
2014/0060122 A1 3/2014 Buso et al.
2017/0145618 A1 5/2017 Borlin et al.

FOREIGN PATENT DOCUMENTS

JP 2015043801 3/2015
JP 2017056076 3/2017
KR 20150026678 3/2015
WO WO2004072350 8/2004

OTHER PUBLICATIONS

Office Action in Chinese Appln. No. 202010078657.5, dated Mar. 7, 2022, 24 pages.

* cited by examiner

LAUNDRY TREATING APPARATUS AND METHOD FOR CONTROLLING THE SAME

CROSS-REFERENCE TO RELATED APPLICATIONS

This application claims the benefit of Korean Patent Application No. 10-2019-0013839, filed on Feb. 1, 2019, and Korean Patent Application No. 10-2019-0046077, filed on Apr. 19, 2019, which is hereby incorporated by reference as when fully set forth herein.

BACKGROUND

Field

The present disclosure relates to a laundry treating apparatus and a method for controlling the same.

Discussion of the Related Art

A laundry treating apparatus includes an apparatus for washing laundry, an apparatus for drying laundry, and an apparatus for washing or drying laundry according to a user's selection. A conventional laundry treating apparatus is classified into a front loading type apparatus for loading laundry into the apparatus through a laundry inlet defined in a front face of the apparatus, and a top loading type apparatus for loading laundry into the apparatus through a laundry inlet defined in a top face of the apparatus.

The front loading type laundry treating apparatus includes a cabinet having a laundry inlet defined in a front face thereof, a tub disposed inside the cabinet to store water therein, a drum rotatably disposed inside the tub to store laundry therein, a spring that connects an upper portion of a circumferential face of the tub to the cabinet, and a damper that connects a lower portion of a circumferential face of the tub to a bottom face of the cabinet.

The damper disposed in the conventional laundry treating apparatus may include a plurality of dampers. Not only the numbers of dampers disposed in the left and right sides to a vertical line passing through a center of the tub are the same, but also the dampers disposed in the left and right sides are disposed at positions symmetrical with respect to the vertical line.

The laundry treating apparatus having the above-described structure has an advantage of effectively absorbing vibration generated from the tub even when the drum rotates in any one of clockwise and counterclockwise directions. However, in the laundry treating apparatus, the vibration of the tub is the largest when the drum is rotated only in one of clockwise and counterclockwise directions at a high rotational speed. Thus, the conventional laundry treating apparatus having the above-described structure may have the number of dampers larger than necessary.

SUMMARY

A purpose of the present disclosure is basically to solve the problem of the conventional laundry treating apparatus as mentioned above.

A purpose of the present disclosure is to provide a laundry treating apparatus for effectively damping the vibration of the tub using a minimum number of dampers, and provide a method for controlling the same.

Further, a purpose of the present disclosure is to provide a laundry treating apparatus capable of effectively attenuating the vibration of the drum and tub by fixing the tub to the cabinet via dampers disposed in asymmetrical positions and disposed in asymmetric numbers with respect to a central vertical line, and to provide a method for controlling the same.

Further, a purpose of the present disclosure is to provide a laundry treating apparatus capable of maximizing attenuation of the vibration by a tub support using weight balancers having different weights or fixed to asymmetric positions of the tub, and to provide a method for controlling the same.

Purposes of the present disclosure are not limited to the above-mentioned purpose. Other purposes and advantages of the present disclosure as not mentioned above may be understood from following descriptions and more clearly understood from embodiments of the present disclosure. Further, it will be readily appreciated that the purposes and advantages of the present disclosure may be realized by features and combinations thereof as disclosed in the claims.

Particular embodiments described herein include a laundry treating apparatus including a cabinet defining a cabinet laundry inlet, a tub, a drum, a drum driver, an elastic member, and first, second, and third dampers. The tub may include a tub body, a front cover portion facing the cabinet laundry inlet, and a rear cover portion. The tub defines a tub laundry inlet at the front cover portion that is in communication with the cabinet laundry inlet. The drum may be disposed inside the tub and rotatable along a rotational axis. The drum may be configured to receive laundry therein. The drum driver may be configured to rotate the drum. The elastic member may connect, to the cabinet, a first portion of the tub body. The first portion may be located vertically above the rotational axis of the drum. The first and second dampers may connect, to the cabinet, a second portion of the tub body. The second portion may be located vertically below the rotational axis. The first and second dampers may be disposed at a first side. The first side may include one of opposite sides of the laundry treating apparatus divided by a vertical plane including the rotational axis. The third damper may connect, to the cabinet, a third portion of the tub body. The third portion may be located vertically below the rotational axis and disposed at a second side. The second side may include the other of the opposite sides of the laundry treating apparatus.

In some implementations, the apparatus can optionally include one or more of the following features. The laundry treating apparatus may include a controller configured to, based on a revolutions per minute (RPM) set for the drum being greater than a preset reference RPM, control the drum driver to rotate the drum in a rotational direction in which the drum is rotated from the second side toward the first side below the rotational axis. The reference RPM may be set to be equal to or higher than a RPM causing a resonance of the tub. The laundry treating apparatus may include a first weight balancer disposed on the front cover portion of the tub at the first side, and a second weight balancer disposed on the front cover portion of the tub at the second side. The first weight balancer may be heavier than the second weight balancer. The laundry treating apparatus may include a third weight balancer disposed on a first portion of the rear cover portion of the tub. The first portion of the rear cover portion may be located vertically below or above the rotational axis. The third weight balancer may be configured to be asymmetric with respect to the vertical plane. The third weight balancer may include a first balancer portion extending from the vertical plane toward the first side, and a second balancer portion extending from the vertical plane toward the second side. The first balancer portion of the third weight balancer may be configured to be heavier than the balancer second portion of the third weight balancer. The laundry treating apparatus may include a fourth weight balancer disposed on a second portion of the rear cover portion of the tub. The second portion of the rear cover portion may be located vertically above the rotational axis. The fourth weight balancer may be configured to be asymmetric with respect to the vertical plane. The fourth weight balancer may include a third balancer portion extending from the vertical plane toward the first side, and a fourth balancer portion extending from the vertical plane toward the second side. The third balancer portion of the fourth weight balancer may be configured to be heavier than the fourth balancer portion of the fourth weight balancer. The laundry treating apparatus may include an insulator that connects the cabinet laundry inlet with the tub laundry inlet. The insulator includes an elastic body. The apparatus may include a residual-water discharge pipe configured to connect the front cover portion to a portion of the insulator. The portion of the insulator may be located vertically below the rotational axis. The residual-water discharge pipe may be configured to guide water from the insulator to the tub body. The first weight balancer may include a first body fixed to the front cover portion, and a first protruding body protruding from the first body and away from the front cover portion. The second weight balancer may include a second body fixed to the front cover portion, a second protruding body protruding from the second body and away from the front cover portion, and a receiving groove located on the second body and configured to receive the residual-water discharge pipe therein to prevent the residual-water discharge pipe from interfering with the second body.

Particular embodiments described herein include a method for controlling a laundry treating apparatus. The apparatus may include a cabinet having a cabinet laundry inlet, a tub, a drum rotatably disposed inside the tub and configured to receive laundry therein, a drum driver configured to rotate the drum along a rotational axis, an elastic member to connect, to the cabinet, a first portion of the tub, the first portion being located vertically above the rotational axis of the drum. The apparatus may further include first, second, and third dampers. The first and second dampers may connect, to the cabinet, a second portion of the tub. The second portion is located vertically below the rotational axis. The first and second dampers may be disposed at a first side. The first side may include one of opposite sides of the laundry treating apparatus divided by a vertical plane including the rotational axis. The third damper may connect, to the cabinet, a third portion of the tub. The third portion may be located vertically below the rotational axis and disposed at a second side. The second side may include the other of the opposite sides of the laundry treating apparatus. The method may include determining a revolutions per minute (RPM) set for the drum that is greater than or equal to a preset reference RPM; and controlling the drum driver to rotate the drum in a first rotational direction in which the drum is rotated from the second side toward the first side below the rotational axis.

In some implementations, the apparatus and the method can optionally include one or more of the following features. The method may include, based on the RPM set for the drum being lower than the preset reference RPM, controlling the drum driver to rotate the drum in a second direction in which the drum is rotated from the first side toward the second side below the rotational axis. The method may include, based on the RPM set for the drum being lower than the preset reference RPM, controlling the drum driver to alternatingly rotate the drum in a first rotational direction and a second rotational direction. The drum may be rotated in the first rotational direction from first side to the second side below the rotational axis, and rotated in the second rotational direction from the second side to the first side below the rotational axis. The laundry treating apparatus may include a controller configured to, based on a revolutions per minute (RPM) set for the drum being greater than a preset reference RPM, control the drum driver to rotate the drum in a rotational direction in which the drum is rotated from the second side toward the first side below the rotational axis. The laundry treating apparatus may include a first weight balancer disposed on the front cover portion of the tub at the first side, and a second weight balancer disposed on the front cover portion of the tub at the second side. The first weight balancer may be heavier than the second weight balancer. The laundry treating apparatus may include a third weight balancer disposed on a first portion of the rear cover portion of the tub. The first portion of the rear cover portion may be located vertically below or above the rotational axis. The third weight balancer may be configured to be asymmetric with respect to the vertical plane. The third weight balancer may include a first balancer portion extending from the vertical plane toward the first side, and a second balancer portion extending from the vertical plane toward the second side. The first balancer portion of the third weight balancer may be configured to be heavier than the balancer second portion of the third weight balancer. The laundry treating apparatus may include a fourth weight balancer disposed on a second portion of the rear cover portion of the tub. The second portion of the rear cover portion may be located vertically above the rotational axis. The fourth weight balancer may be configured to be asymmetric with respect to the vertical plane. The fourth weight balancer may include a third balancer portion extending from the vertical plane toward the first side, and a fourth balancer portion extending from the vertical plane toward the second side. The third balancer portion of the fourth weight balancer may be configured to be heavier than the fourth balancer portion of the fourth weight balancer. The laundry treating apparatus may include an insulator that connects the cabinet laundry inlet with the tub laundry inlet. The insulator includes an elastic body. The apparatus may include a residual-water discharge pipe configured to connect the front cover portion to a portion of the insulator. The portion of the insulator may be located vertically below the rotational axis. The residual-water discharge pipe may be configured to guide water from the insulator to the tub body.

One aspect of the present disclosure provides a laundry treating apparatus comprising: a cabinet; a tub having a hollow cylindrical shape; a drum rotatably disposed inside the tub to store laundry therein; an elastic member to connect an upper region of a circumferential face of the tub to the cabinet; and dampers for connecting a lower region of the circumferential face of the tub to the cabinet, wherein the number of dampers on one side to a vertical line passing through a rotation center of the drum is greater than the number of dampers on the other side to the vertical line.

One aspect of the present disclosure provides a laundry treating apparatus comprising: a cabinet; a tub having a hollow cylindrical shape; a drum rotatably disposed inside the tub to store laundry therein; an elastic member to connect an upper region of a circumferential face of the tub to the cabinet; dampers for connecting a lower region of the circumferential face of the tub to the cabinet, wherein the number of dampers on one side to a vertical line passing through a rotation center of the drum is greater than the number of dampers on the other side to the vertical line; and a controller, wherein a RPM (revolutions per minute) set for the drum is greater than a preset reference RPM, the controller is configured for rotating the drum in a direction from a location in which the smaller number of dampers are disposed to a location in which the larger number of dampers are disposed.

One aspect of the present disclosure provides a laundry treating apparatus comprising: a cabinet having a cabinet laundry inlet defined therein; a tub including: a tub body having a hollow cylindrical shape; a front cover facing the cabinet laundry inlet to define a front face of the tub body; a rear cover defining a rear face of the tub body; and a tub laundry inlet passing through the front cover and communicating with the cabinet laundry inlet; a drum rotatably disposed inside the tub to store laundry therein; a drum driver for rotating the drum; an elastic member to connect, to the cabinet, a portion of a space defined in the tub body, the portion being located above a horizontal line passing through a rotation center of the drum; first and second dampers to connect, to the cabinet, a portion of the space defined in the tub body, the portion being located below the horizontal line, wherein a first location is defined as one of left and right portions of the space defined in the tub body relative to a vertical line passing through the rotation center of the drum, while a second location is defined as the other of the left and right portions, wherein both of the first damper and second damper are disposed at the first location; and a third damper to connect, to the cabinet, a portion of the space defined in the tub body, the portion being located below the horizontal line, wherein the third damper is disposed at the second location.

In one implementation, the laundry treating apparatus further comprises a controller, wherein when a RPM (revolutions per minute) set for the drum is greater than a preset reference RPM, the controller is configured for controlling the drum driver so that the drum rotates in a direction from the second location toward the first location.

In one implementation, the reference RPM is set to be equal to or higher than a RPM causing a resonance of the tub.

In one implementation, the laundry treating apparatus further comprises: a first weight balancer disposed on one portion positionally corresponding to the first location among two portions of the front cover divided by a vertical line V passing through the rotation center of the drum; and a second weight balancer disposed on the other portion positionally corresponding to the second location among the two portions of the front cover divided by the vertical line passing through the rotation center of the drum, wherein a weight of the first weight balancer is set to be larger than a weight of the second weight balancer.

In one implementation, the laundry treating apparatus further comprises a third weight balancer disposed fixedly in a portion of a space defined by the rear cover of the tub, the portion being located below or above the horizontal line passing through the rotation center of the drum, wherein a shape of the third weight balancer is asymmetric with respect to the vertical line passing through the rotation center of the drum.

In one implementation, a weight of a portion of the third weight balancer extending from the vertical line toward the first location is set to be larger than a weight of a portion thereof extending from the vertical line toward the second location.

In one implementation, the laundry treating apparatus further comprises a fourth weight balancer disposed fixedly in a portion of a space defined by the rear cover of the tub, the portion being located above the horizontal line passing through the rotation center of the drum, wherein a shape of the fourth weight balancer is asymmetric with respect to the vertical line passing through the rotation center of the drum.

In one implementation, a weight of a portion of the fourth weight balancer extending from the vertical line toward the first location is set to be larger than a weight of a portion thereof extending from the vertical line toward the second location.

In one implementation, the laundry treating apparatus further comprises: an insulator for connecting the cabinet laundry inlet and the tub laundry inlet with each other, wherein the insulator is embodied as an elastic body; and a residual-water discharge pipe for connecting the front cover to a portion of a space defined by the insulator, the portion being located below the horizontal line passing through the rotation center of the drum, wherein the residual-water discharge pipe is constructed to guide water inside the insulator to the tub body.

In one implementation, the first weight balancer includes: a first body fixed to the front cover and located inside a space defined by the front cover; and a first protruding body protruding from the first body and located outside the space defined by the front cover, wherein the second weight balancer includes: a second body fixed to the front cover and located inside a space defined by the front cover; a second protruding body protruding from the second body and located outside the space defined by the front cover; and a receiving groove concavely defined in one end of the second body to receive the residual-water discharge pipe therein to prevent the residual-water discharge pipe from interfering with the second body.

One aspect of the present disclosure provides a method for controlling a laundry treating apparatus, wherein the apparatus includes: a cabinet having a cabinet laundry inlet defined therein; a tub having a hollow cylindrical shape; a drum rotatably disposed inside the tub to store laundry therein; a drum driver for rotating the drum; an elastic member to connect, to the cabinet, a portion of a space defined in the tub, the portion being located above a horizontal line passing through a rotation center of the drum; first and second dampers to connect, to the cabinet, a portion of the space defined in the tub, the portion being located below the horizontal line, wherein a first location is defined as one of left and right portions of the space defined in the tub relative to a vertical line passing through the rotation center of the drum, while a second location is defined as the other of the left and right portions, wherein both of the first damper and second damper are disposed at the first location; and a third damper to connect, to the cabinet, a portion of the space defined in the tub, the portion being located below the horizontal line, wherein the third damper is disposed at the second location, wherein the method comprises, when a RPM (revolutions per minute) set for the drum is greater than or equal to a preset reference RPM, controlling the drum driver so that the drum rotates in a direction from the second location toward the first location.

In one implementation, the method further comprises, when the RPM set for the drum is lower than the preset reference RPM, controlling the drum driver so that the drum rotates in a direction from the first location toward the second location.

In one implementation, the method further comprises, when the RPM set for the drum is lower than the preset reference RPM, controlling the drum driver so that a step of rotating the drum in a direction from the first location to the second location, and a step of rotating the drum in a direction from the second location to the first location are alternately performed.

The features of the above-described implantations may be combined with other embodiments as long as they are not contradictory or exclusive to each other.

Effects of the present disclosure are as follows but are limited thereto:

In accordance with the present disclosure, a laundry treating apparatus for effectively damping the vibration of the tub using a minimum number of dampers, and a method for controlling the same may be realized.

Further, in accordance with the present disclosure, a laundry treating apparatus capable of effectively attenuating the vibration of the drum and tub by fixing the tub to the cabinet via dampers disposed in asymmetrical positions and disposed in asymmetric numbers with respect to a central vertical line, and a method for controlling the same may be realized.

Further, in accordance with the present disclosure, a laundry treating apparatus capable of maximizing attenuation of the vibration by a tub support using weight balancers having different weights or fixed to asymmetric positions of the tub, and a method for controlling the same may be realized.

Effects of the present disclosure are not limited to the above effects. Those skilled in the art may readily derive various effects of the present disclosure from various configurations of the present disclosure.

DETAILED DESCRIPTIONS

Figure 1:
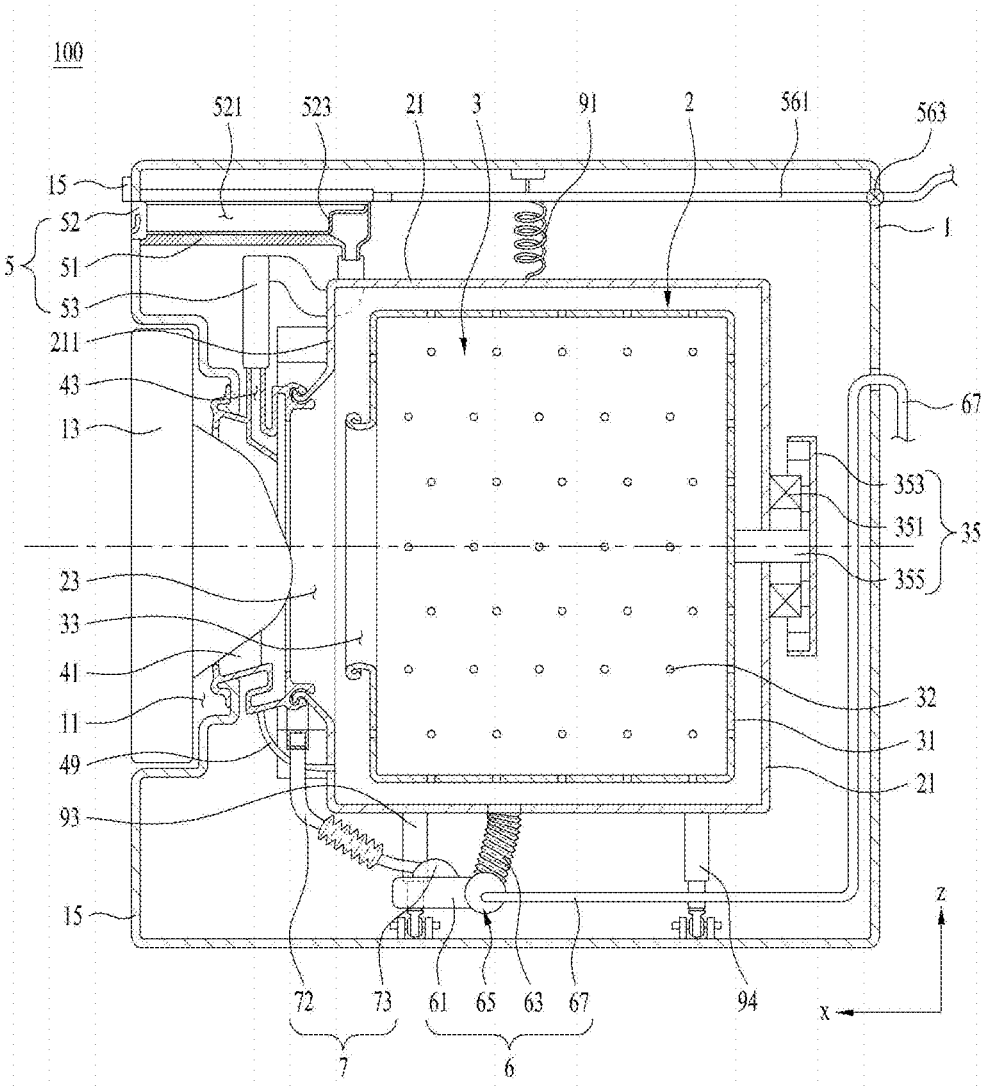
FIG. 1 and FIG. 2 show an example of a laundry treating apparatus.

For simplicity and clarity of illustration, elements in the figures are not necessarily drawn to scale. The same reference numbers in different figures denote the same or similar elements, and as such perform similar functionality. Furthermore, in the following detailed description of the present disclosure, numerous specific details are set forth in order to provide a thorough understanding of the present disclosure. However, it will be understood that the present disclosure may be practiced without these specific details. In other instances, well-known methods, procedures, components, and circuits have not been described in detail so as not to unnecessarily obscure aspects of the present disclosure.

Examples of various embodiments are illustrated and described further below. It will be understood that the description herein is not intended to limit the claims to the specific embodiments described. On the contrary, it is intended to cover alternatives, modifications, and equivalents as may be included within the spirit and scope of the present disclosure as defined by the appended claims.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises", "comprising", "includes", and "including" when used in this specification, specify the presence of the stated features, integers, operations, elements, and/or components, but do not preclude the presence or addition of one or more other features, integers, operations, elements, components, and/or portions thereof. As used herein, the term "and/or" includes any and all combinations of one or more of the associated listed items. Expression such as "at least one of" when preceding a list of elements may modify the entire list of elements and may not modify the individual elements of the list.

It will be understood that, although the terms "first", "second", "third", and so on may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

In addition, it will also be understood that when a first element or layer is referred to as being present "on" or "beneath" a second element or layer, the first element may be disposed directly on or beneath the second element or may be disposed indirectly on or beneath the second element with a third element or layer being disposed between the first and second elements or layers. It will be understood that when an element or layer is referred to as being "connected to", or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may be present.

Unless otherwise defined, all terms including technical and scientific terms used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As shown in FIG. 1, a laundry treating apparatus 100 includes a cabinet 1, a tub 2 disposed inside the cabinet to store water therein, and a drum 3 rotatably disposed inside the tub for storing laundry therein.

The cabinet 1 has a base 15 to form a bottom face of the laundry treating apparatus (a bottom face of the cabinet), a front panel to form a front face of the laundry treating apparatus, a rear panel to form a rear face of the laundry treating apparatus, and a top face of the laundry treating apparatus, and a first side panel 16 (see FIG. 2) and a second side panel 17 (see FIG. 2) fixed to the base 15 to form left and right side faces of the laundry treating apparatus, respectively.

The front panel has a cabinet laundry inlet 11 defined therein through which laundry is input into the drum 3 or laundry is withdrawn from the drum to an outside of the cabinet. The cabinet laundry inlet 11 may be opened and closed by a door 13. The door 13 may be rotatably coupled to the front panel.

The tub 2 has a hollow cylindrical tub body 21, a front cover 211 fixed to the tub body to form a front face of the tub, and a rear cover 213 fixed to the tub body to form a rear face of the tub.

The front cover 211 faces the front panel having the cabinet laundry inlet 11. The rear cover 213 faces the rear panel. The front cover 211 has a tub laundry inlet 23 defined therein communicating with the cabinet laundry inlet 11.

The cabinet laundry inlet 11 and the tub laundry inlet 23 are connected with each other via an insulator. The insulator not only prevents water stored in the tub body 21 from being discharged to the cabinet 1 through the tub laundry inlet 23, but also attenuates the vibration of the tub body 21 from being transmitted to the cabinet 1.

The insulator is embodied as an elastic body (made of rubber or the like) and has an insulating body 41 connecting the cabinet laundry inlet 11 and the tub laundry inlet 23 with each other. The insulating body 41 has a cylindrical first fixed body having one end fixed to the cabinet laundry inlet 11, a cylindrical second fixed body having the other end fixed to the tub laundry inlet 23, a connecting body connecting a free end of the first fixed body and a free end of the second fixed body with each other.

To prevent water from remaining inside the insulating body 41, the insulator may further have a residual-water discharge pipe 49 connecting the insulating body 41 and the front cover 211 of the tub body with each other. The residual-water discharge pipe 49 is preferably configured to connect a portion of a space defined by the insulating body 41 as located below a horizontal line H passing through a rotation center of the drum 3 to the front cover 211. This configuration is intended to move the water inside the insulating body 41 to the tub body 21 without a separate device.

The drum 3 includes a drum body 31 rotatable inside the tub body 21. The drum body 31 has a hollow cylindrical shape. Each of a circumferential face, a front face and a rear face of the drum body 31 has drum through-holes 32 defined therein which communicate an inside of the drum body with an inside of the tub body. Further, a drum laundry inlet 33 is defined in a face (the front face of the drum) of a space defined by the drum body 31 facing the cabinet laundry inlet 11.

The drum body 31 is rotated by a drum driver 35. The drum driver 35 includes a stator 351 fixed to a back of the tub body 21 to generate a rotating field, a rotor 353 located outside of the tub body 21 to rotate using the magnetic field, and a rotation shaft 355 to penetrate the rear face of the tub body 21 and connect the rotor 353 and the drum body 31 with each other.

The water stored in the tub body 21 is discharged out of the cabinet 1 via a water discharger 6. The water discharger 6 may include a chamber 61 which provides a space for storing water therein, a first water discharge pipe 63 which directs water from the tub body 21 to the chamber 61, and a water discharge pump 65 to transfer water introduced into the chamber 61 to a second water discharge pipe 67. The second water discharge pipe 67 refers to means for directing the water discharged from the water discharge pump 65 to an outside of the cabinet and may be configured such that the highest point of the second water discharge pipe 67 passes through a point higher than the lowest point of the tub laundry inlet 23.

In order to shorten the washing time or increase the washing power, the laundry treating apparatus 100 may further include a water ejector 7 for ejecting water stored in the tub body 21 toward the drum laundry inlet 33.

Figure 2:
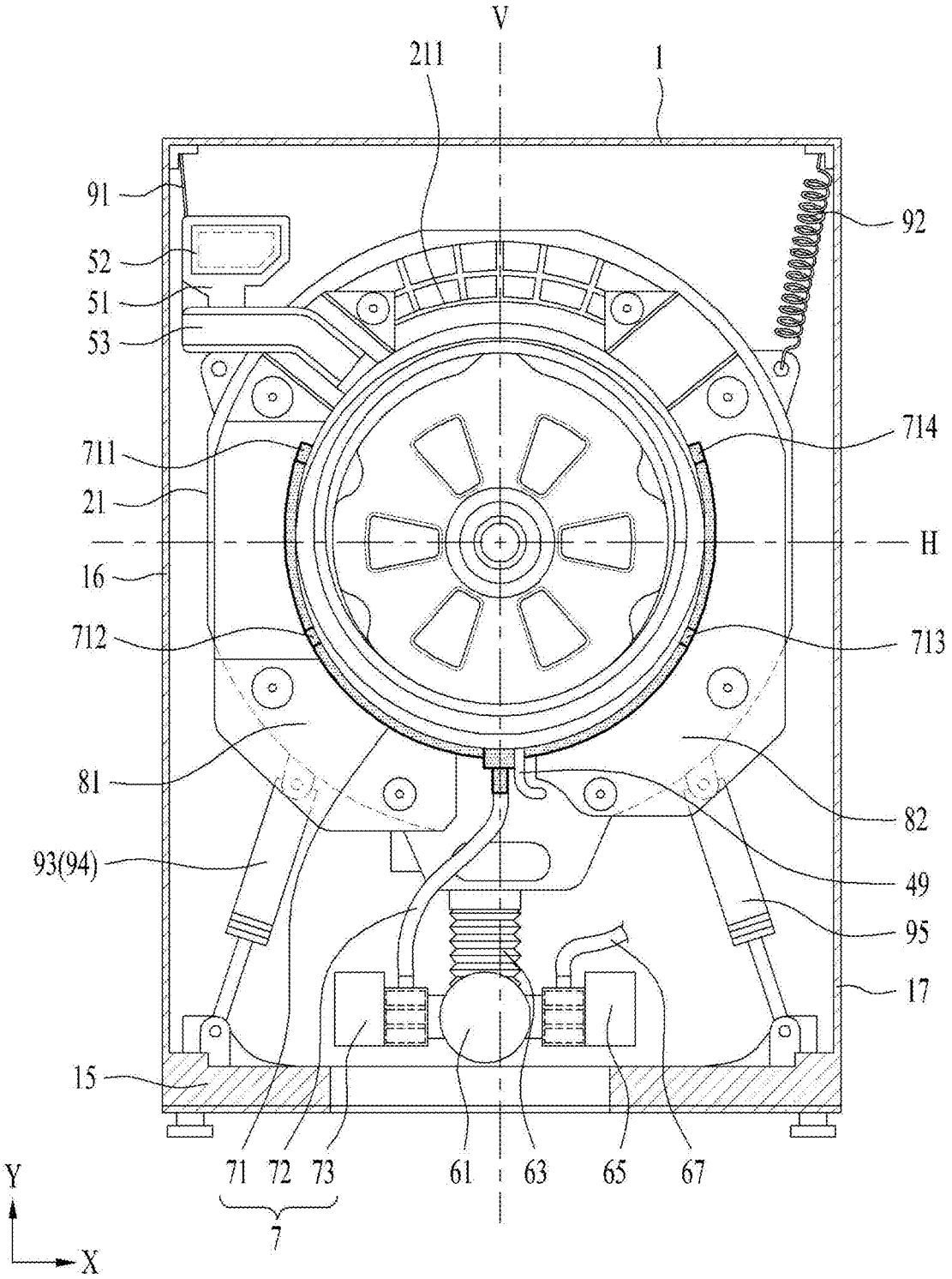

As shown in FIG. 2, the water ejector 7 may include a channel body 71 fixed to the front panel of the tub body 21, a supply pipe 72 that guides water to the channel body 71, and a circulating pump 73 that moves the water inside the tub body 21 to the supply pipe 72. The channel body 71 has a fan-shaped channel defined therein extending along a circumferential face of the tub laundry inlet 23. The circulating pump 73 may be configured to supply water inside the chamber 61 to the supply pipe 72.

The channel body 71 may has a first nozzle 711, a second nozzle 713, a third nozzle 715, and a fourth nozzle 717 from which water is discharged. The first nozzle 711 and second nozzle 713 may be disposed on a left side to a vertical line V passing through a center of the tub laundry inlet 23. The third nozzle 715 and fourth nozzle 717 may be disposed on a right side to the vertical line V.

As shown in FIG. 1, a detergent supply 5 included in the laundry treating apparatus 100 may be configured to include a casing 51 disposed in the cabinet 1, and a drawer 52 withdrawable from the casing 51.

The drawer 52 housed inside the casing 51 may be drawn out of the cabinet 1 through a drawer outlet (not shown) configured to penetrate the front panel of the cabinet 1. The drawer 52 may have a polyhedron shape (hexahedron shape) with an open top face. The drawer may be configured to include a storage 521 which provides a space in which a detergent is stored, and a detergent outlet 523 which communicates the storage 521 with the casing 51. The detergent outlet 523 may be embodied as a through-hole passing through a rear face or bottom face of the storage 521 or may be embodied as a bell trap disposed on a bottom face of the storage 521.

The casing 51 has a water supply that supplies water to the storage 521. FIG. 1 shows an example where the water supply supplies water to a top face of the casing 51.

The water supply includes a water supply pipe 561 that supplies water from a water supply source to the storage 521, and a water supply valve 563 that opens or closes the water supply pipe 561 according to a control signal from a controller (not shown). Thus, when water is supplied to the storage 521 in which the detergent is stored through the water supply pipe 561, the detergent in the storage 521 moves, together with the water, to the casing 51 through the detergent outlet 523.

Water and detergent discharged to the casing 51 may be fed into the tub body 21 through the insulating body 41. To this end, the insulator 4 may have an inflow pipe 43 into which water and detergent are introduced. The detergent supply 5 may have an outflow pipe 53 which directs the detergent and water to the inflow pipe 42. Each of the inflow pipe 42 and the outflow pipe 53 may be made of an elastic material (rubber or the like). Thus, the inflow pipe 42 and outflow pipe 53 may allow minimizing the transfer of the vibration to the casing 51 and the front panel 15.

The tub 2 having the above-described structure is fixed inside the cabinet 1 via a tub support. The tub support may be composed of an elastic member 91 and 92 and dampers 93, 94 and 95.

As shown in FIG. 2, the elastic member may include a first spring 91 and a second spring 92 that connect a portion of a circumferential face of the tub body 21 located above a horizontal line H passing through a center of the tub body to the cabinet 1.

In this case, the cabinet 1 may further include a frame to which each spring is fixed. The frame may include a first frame disposed at a corner where the first side panel 16 and the top panel meet with each other, and to which the first spring 91 is fixed, and a second frame disposed at a corner where the top panel and the second side panel 17 meet with each other and to which the second spring 92 is fixed.

The damper may include a plurality of dampers 93, 94 and 95 that connect the base 15 with a portion of the circumferential face of the tub body 21 located below the horizontal line H passing through the center of the tub body (or the rotation center of the drum).

Figure 3A:
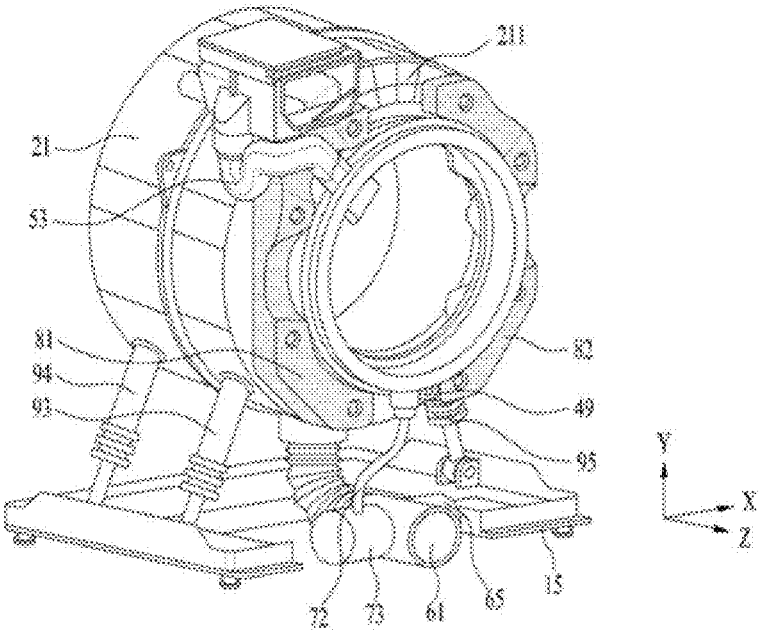
FIGS. 3A and 3B show an example of a tub support disposed in the laundry treating apparatus.

As shown in FIG. 3A, the damper may include a first damper 93 and a second damper 94 disposed at a first location, and a third damper 95 disposed at a second location.

Figure 3B:
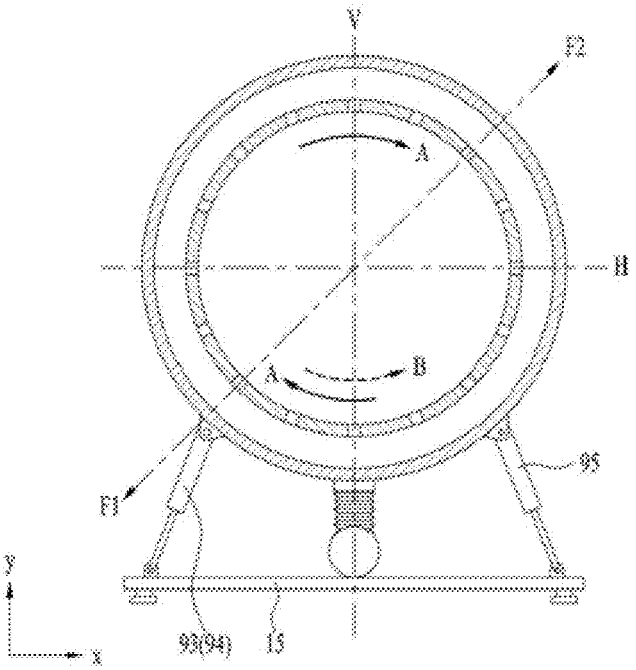

In this connection, the first location may be defined as one of left and right portions of a space defined in the tub body 21 relative to the vertical line V passing through the center of the tub body 21. The second location may be defined as the other of the left and right portions of the space defined in the tub body 21 relative to the vertical line V passing through the center of the tub body 21. FIGS. 3A and 3B show one example where the first location is the left space relative to the vertical line V, while the second location is the right space relative to the vertical line V.

Each of the first damper 93, second damper 94, and third damper 95 may have any structure as long as each damper may absorb the vibration of the tub body 21. An example thereof may be a hydraulic damper.

The hydraulic damper may include a cylinder to provide a space for fluid to be stored therein, the cylinder being fixed to either a circumferential face of the tub body or the base 15, and a piston having one end located inside the cylinder and the other end fixed to the base 15. When the tub body 21 vibrates, one end of the piston located inside the cylinder reciprocates along the cylinder. In this process, the vibration of the tub body 21 is attenuated by friction between one end of the piston and the fluid.

The laundry treating apparatus 100 has a feature that the number of the dampers 93 and 94 disposed at the first location and the number of the damper 95 disposed at the second location may not be equal to each other, and positions of the dampers at the first location and the position of the damper at the second location are not symmetrical with each other with respect to the vertical line.

In a conventional laundry treating apparatus, the number of the dampers disposed at the first location and the number of the dampers disposed at the second location are equal to each other, and positions of the dampers at the first location and the positions of the dampers at the second location are symmetrical with each other with respect to the vertical line.

The laundry treating apparatus having the above-described structure has an advantage of effectively absorbing vibration generated from the tub body 21 even when the drum 3 rotates in any one of clockwise and counterclockwise directions. However, in the laundry treating apparatus, the vibration of the tub body 21 is the largest when the drum 3 is rotated only in one of clockwise and counterclockwise directions at a high rotational speed. Thus, the conventional laundry treating apparatus having the above-described structure may have the number of dampers larger than necessary.

For example, it may be assumed that the drum 3 rotates in a clockwise direction in a spinning cycle. In this case, the dampers located on the left side to the vertical line V play a greater role in absorbing the vibration of the tub body 21, whereas the dampers located on the right side to the vertical line V play a relatively smaller role in absorbing the vibration of the tub body 21. Therefore, the conventional design in which the same numbers of the dampers are arranged at symmetrical points has a disadvantage in that a larger number of dampers are used than necessary.

The above-described problem may be solved by the laundry treating apparatus 100 as follows. As mentioned above, the laundry treating apparatus 100 has the feature that the number of the dampers 93 and 94 disposed at the first location and the number of the damper 95 disposed at the second location may not be equal to each other, and positions of the dampers at the first location and the position of the damper at the second location are not symmetrical with each other with respect to the vertical line. Further, the laundry treating apparatus 100 has a feature that when a RPM (revolutions per minute) set for the drum is greater than or equal to a preset reference RPM, a rotation direction of the drum 3 is specified accordingly.

That is, in a cycle in which the drum rotates at high speed as in the spinning cycle, the controller controls the drum driver 35 so that the drum 3 rotates in a direction from the second location toward the first location, thereby effectively dampen the vibration of the tub body 21.

As shown in FIG. 3B, when the drum 3 rotates in a direction from the second location to the first location, the biggest vibration generated from the tub body 21 includes vibration F1 toward a left corner of the first location and vibration F2 toward a right corner of the second location. The two vibrations F1 and F2 are attenuated by the first damper 93 and the second damper 94 disposed at the first location. Therefore, the laundry treating apparatus 100 may effectively attenuate the vibration occurring in the tub body 21 while minimizing the number of the dampers.

The reference RPM may be set to the same RPM as a RPM that causes a resonance of the tub body 21, or may be set to an RPM greater than the RPM that causes the resonance of the tub body 21. Alternatively, the reference RPM may be set to be equal to a RPM that causes a resonance of the laundry treating apparatus 100 or may be set to an RPM greater than the RPM that causes the resonance of the laundry treating apparatus 100.

However, when the RPM set for the drum 3 is lower than the reference RPM, the controller may rotate the drum 3 in a direction from the first location to the second location. In this case, the third damper 95 disposed at the second location will be able to absorb the small vibration of the tub body 21.

When the RPM of the drum as set in a cycle (washing and rinsing cycles) when the laundry rubs against water and contaminants are removed from the laundry is lower than the reference RPM, the controller may alternately perform a step B of rotating the drum 3 in a direction from the first location to the second location and a step A of rotating the drum 3 in a direction from the second location to the first location.

To more effectively dampen the vibration of the tub body 21, the laundry treating apparatus may further include at least one of a front weight 81 and 82 disposed on the front cover 211 of the tub, and a rear weight 84 and 86 disposed on the rear cover 213 of the tub.

As shown in FIG. 2, the front weight 81 and 82 may include a first weight balancer 81 and a second weight balancer 82 disposed with the tub laundry inlet 23 interposed therebetween.

The first weight balancer 81 may be disposed on one portion positionally corresponding to the first location among two portions of the front cover 211 divided by the vertical line V passing through the rotation center of the drum 3. The second weight balancer 82 may be disposed on the other portion positionally corresponding to the second location among two portions of the front cover 211 divided by the vertical line V passing through the rotation center of the drum 3. In this case, when a weight of the first weight balancer 81 is set to be larger than a weight of the second weight balancer 82, the laundry treating apparatus 100 may more effectively control the vibration of the tub body 21 when the drum 3 rotates at a RPM above the reference RPM.

Increasing the weight of the tub 2 means that a large amount of energy is required to vibrate the tub 2. As the weight of the tub 2 increases, the vibration of the drum 3 to vibrate the tub 2 increases. When the RPM set for the drum is greater than the reference RPM, the controller disposed in the laundry treating apparatus 100 rotates the drum 3 in a direction from the second location to the first location. Thus, when the first weight balancer 81 positionally corresponding to the first location is larger than the second weight balancer 82 positionally corresponding to the second location, the laundry treating apparatus 100 may more effectively attenuate the vibration generated from the tub body 21 when the drum rotates at a RPM higher than the reference RPM.

Figure 4:
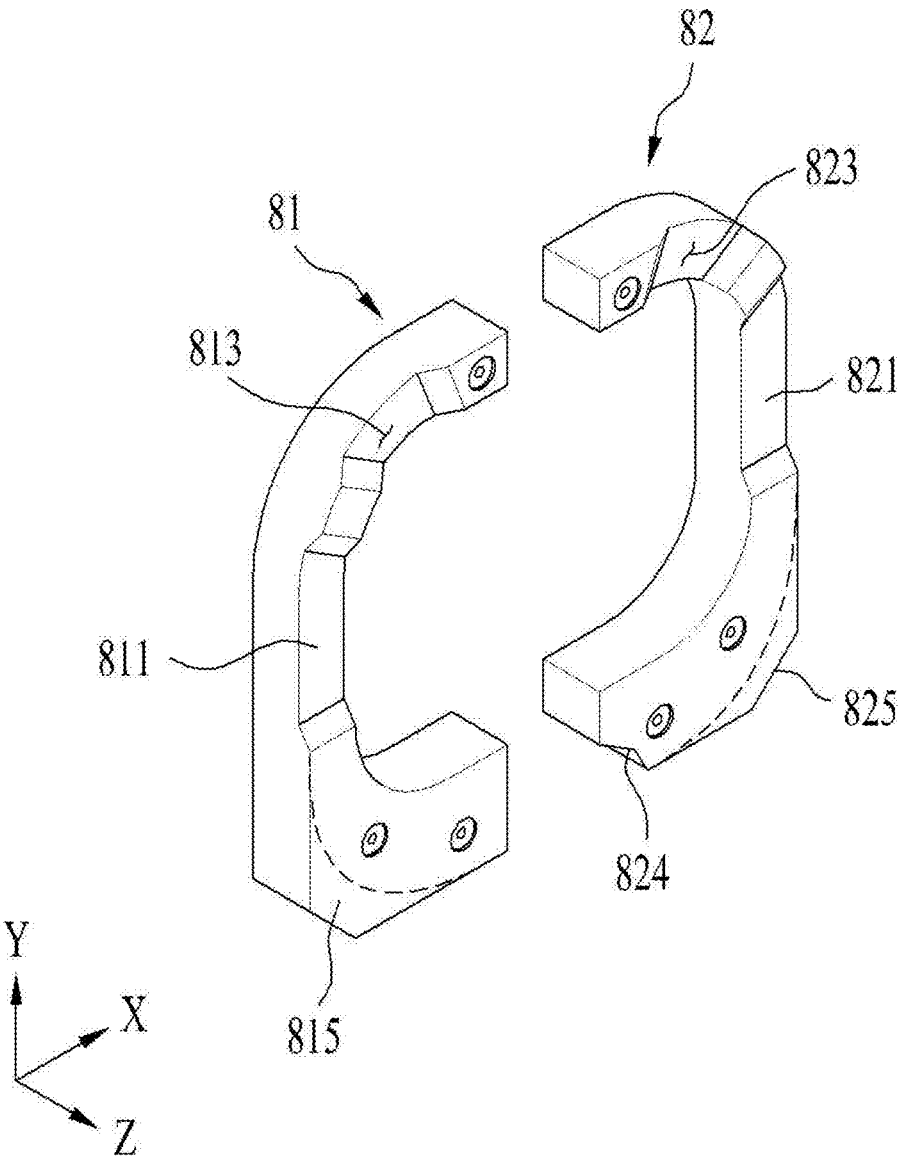
FIG. 4 shows an example of a front weight disposed in the laundry treating apparatus.

As shown in FIG. 4, the first weight balancer 81 has a first body 811 fixed to the front cover 211, and a first protruding body protruding from the first body 811 toward a corner where the first side panel 16 and the base 15 join together.

The second weight balancer 82 may include a second body 821 fixed to the front cover 211 and a second protruding body 825 protruding from the second body 821 toward a corner at which the second side panel 17 and the base 15 join together.

The first protruding body 815 and the second protruding body 825 act to respectively maximize the weights of the first weight balancer 81 and the second weight balancer 82 which are located inside the cabinet with a limited volume.

At least one of the first body 811 and the second body 821 may further have an outflow pipe receiving groove for receiving the outflow pipe 53 of the detergent supply 5. FIG. 4 shows one example where the first weight balancer 81 has a first outflow pipe receiving groove 813 concavely defined in a surface of the first body 811, and the second weight balancer 82 has a second outflow pipe receiving groove 823 concavely defined in a surface of the second body 821.

The configuration that the outflow pipe receiving grooves 813 and 823 are defined in the two weight balancers 81 and 82 respectively may prevent the front weight 81 and 82 from interfering with the outflow pipe 53 as a position of the detergent supply 5 changes.

One of the first weight balancer 81 and the second weight balancer 82 may be configured to have a receiving groove defined therein to receive the residual-water discharge pipe 49 such that the weight balancers 81 and 82 is prevented from interfering with the residual-water discharge pipe 49. FIG. 4 illustrates an example in which the receiving groove 824 is defined in the second body 821 because the weight of the first weight balancer 81 should be set to be larger than the weight of the second weight balancer 82. In this case, the receiving groove 824 may be concavely defined in one end of the second body 821.

Figure 5:
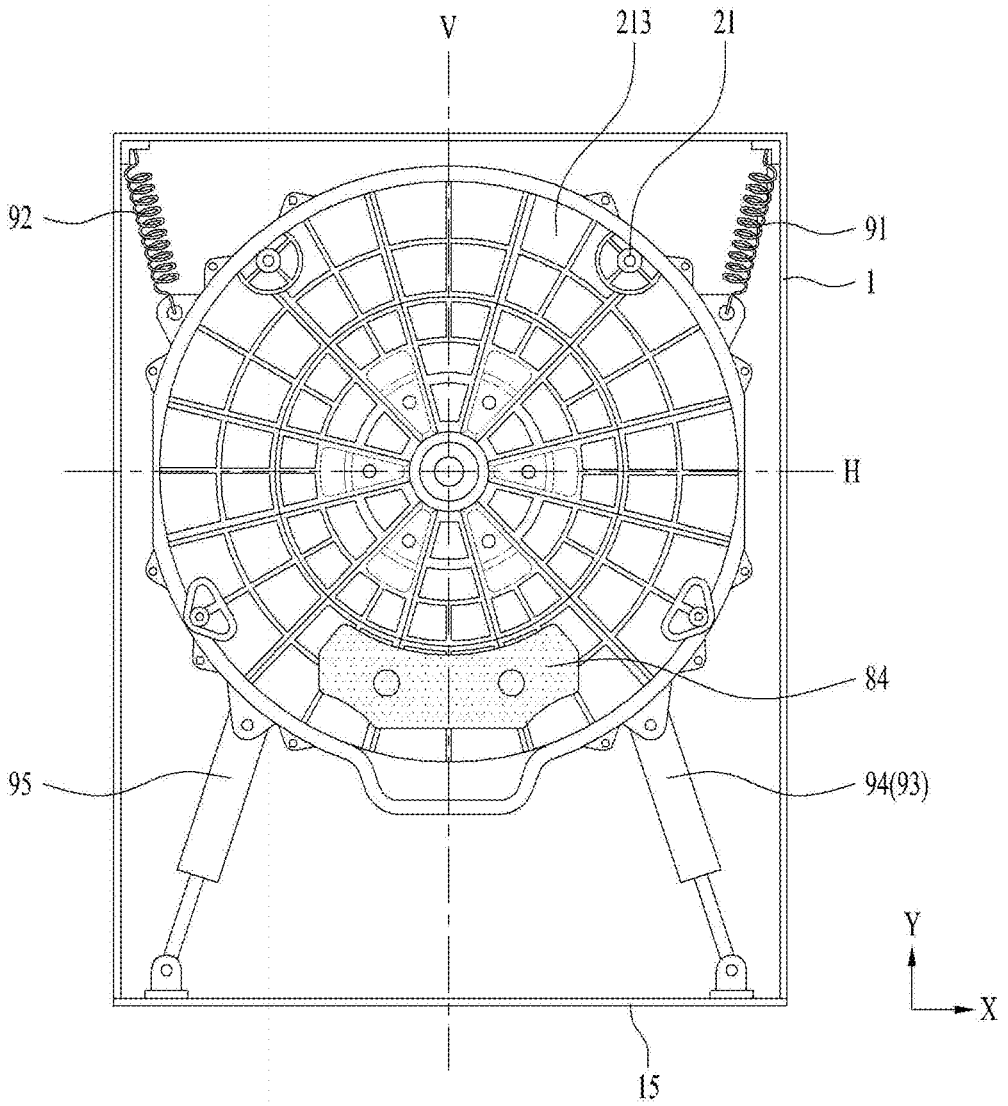
FIG. 5 and FIG. 6 shows an example of a rear weight disposed in the laundry treating apparatus.

FIG. 5 shows an example of the rear weight. The rear weight may include a third weight balancer 84 disposed fixedly in a portion of a space defined by the rear cover 213 of the tub as located below the horizontal line H passing through the rotation center of the drum 3.

The third weight balancer 84 may have a symmetrical shape with respect to the vertical line V passing through the rotation center of the drum or may have an asymmetrical shape with respect to the vertical line V passing through the rotation center of the drum. In the latter case, a weight of a portion of the third weight balancer 84 extending from the vertical line V toward the first location (where the two dampers are located) is larger than a weight of a portion of the third weight balancer 84 extending from the vertical line V toward the second location (where one damper is located). This configuration is intended to more effectively dampen the vibration generated from the tub body 21 when the drum 3 rotates at a RPM higher than the reference RPM.

Unlike the FIG. 5, the third weight balancer 84 may be fixed disposed in a portion of a space defined by the rear cover 213 as located above the horizontal line H.

Figure 6:
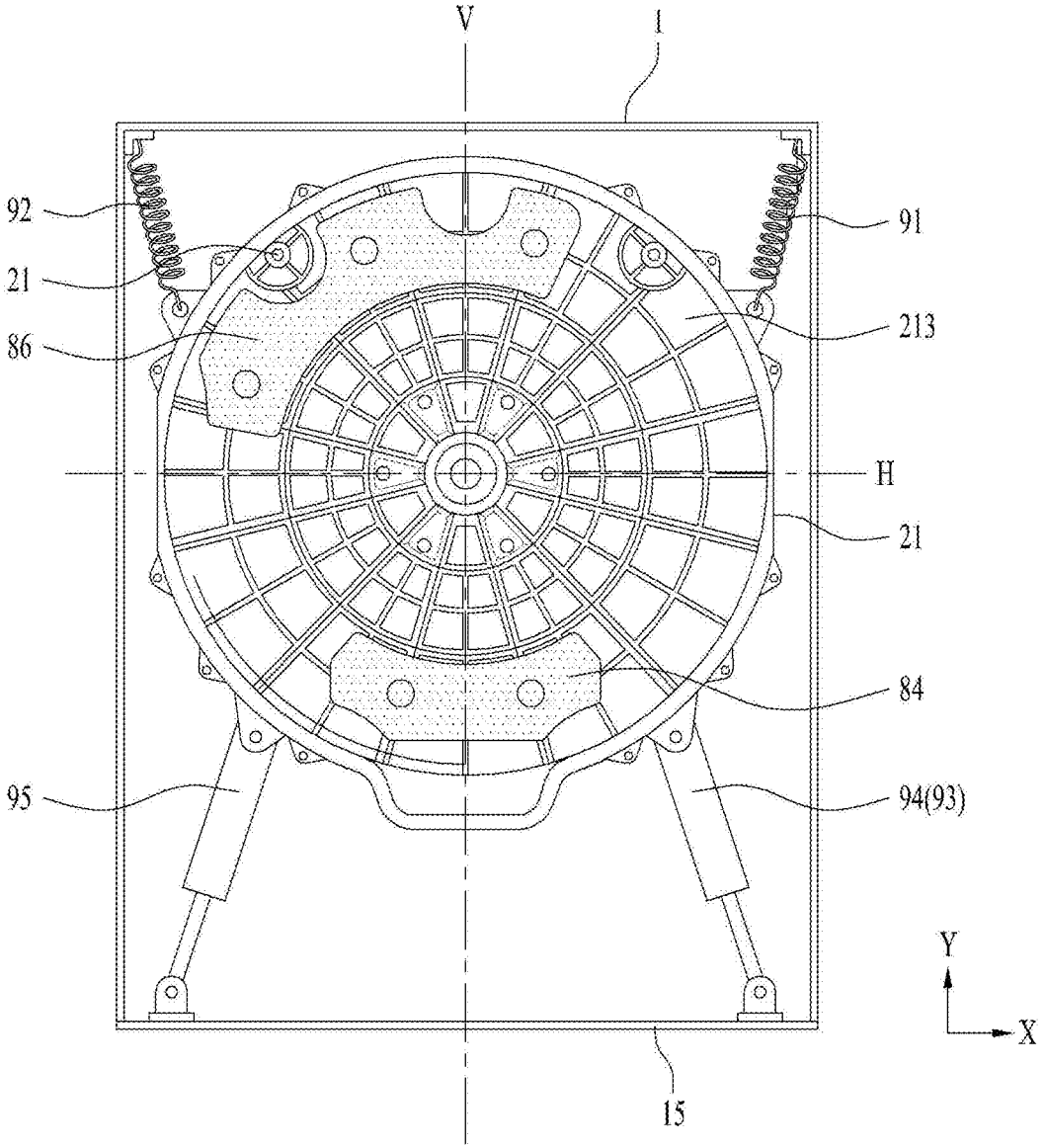

FIG. 6 shows another embodiment of the rear weight, where the rear weight includes a third weight balancer 84 fixedly disposed in a portion of the space defined by the rear cover 213 of the tub as provided below the horizontal line H, and a fourth weight balancer 86 fixedly disposed in a portion of the space defined by the rear cover 213 of the tub as provided above the horizontal line H.

The feature of the third weight balancer 84 is the same as has been described in the embodiment of FIG. 5. Thus, the detailed description is omitted.

A shape of the fourth weight balancer 86 may have a shape symmetrical about the vertical line V passing through the rotation center of the drum, or an asymmetrical shape about the vertical line V passing through the rotation center of the drum. In the latter case, a weight of a portion of the fourth weight balancer 86 extending from the vertical line V toward the first location is preferably set to be larger than a weight of a portion of the fourth weight balancer 86 extending from the vertical line V toward the second location. Unlike FIG. 6, the rear weight may include only the fourth weight balancer 86.

The laundry treating apparatus 100 may be embodied in various forms. Effects as not described herein may be derived from the above configurations. The relationship between the above-described components may allow a new effect not seen in the conventional approach to be derived.

In addition, embodiments shown in the drawings may be modified and implemented in other forms. The modifications should be regarded as falling within a scope of the present disclosure when the modifications is carried out so as to include a component claimed in the claims or within a scope of an equivalent thereto.

What is claimed is:

1. A laundry treating apparatus comprising:

a cabinet defining a cabinet laundry inlet;

a tub including:

a tub body, a front cover portion facing the cabinet laundry inlet, and a rear cover portion, wherein the tub defines a tub laundry inlet at the front cover portion that is in communication with the cabinet laundry inlet;

a drum disposed inside the tub and rotatable along a rotational axis, the drum configured to receive laundry therein;

a drum driver configured to rotate the drum;

an elastic member that connects, to the cabinet, a first portion of the tub body, the first portion being located vertically above the rotational axis of the drum;

first and second dampers that connect, to the cabinet, a second portion of the tub body, the second portion being located vertically below the rotational axis, the first and second dampers being disposed at a first side, wherein the first side includes one of opposite sides of the laundry treating apparatus divided by a vertical plane including the rotational axis;

a third damper that connects, to the cabinet, a third portion of the tub body, the third portion being located vertically below the rotational axis and disposed at a second side, wherein the second side includes the other of the opposite sides of the laundry treating apparatus;

a first weight balancer disposed on the front cover portion of the tub at the first side;

a second weight balancer disposed on the front cover portion of the tub at the second side, wherein the first weight balancer is heavier than the second weight balancer;

an insulator that connects the cabinet laundry inlet with the tub laundry inlet, the insulator including an elastic body; and a residual-water discharge pipe configured to connect the front cover portion to a portion of the insulator, the portion of the insulator being located vertically below the rotational axis, wherein the residual-water discharge pipe is configured to guide water from the insulator to the tub body, wherein the first weight balancer includes:

a first body fixed to the front cover portion, and a first protruding body protruding from the first body and away from the front cover portion, and wherein the second weight balancer includes:

a second body fixed to the front cover portion, a second protruding body protruding from the second body and away from the front cover portion, and a receiving groove located on the second body and configured to receive the residual-water discharge pipe therein to prevent the residual-water discharge pipe from interfering with the second body.

2. The laundry treating apparatus of claim 1, further comprising:

a third weight balancer disposed on a first portion of the rear cover portion of the tub, the first portion of the rear cover portion being located vertically below or above the rotational axis, wherein the third weight balancer is configured to be asymmetric with respect to the vertical plane.

3. The laundry treating apparatus of claim 2, wherein the third weight balancer includes a first balancer portion extending from the vertical plane toward the first side, and a second balancer portion extending from the vertical plane toward the second side, the first balancer portion of the third weight balancer configured to be heavier than the second balancer portion of the third weight balancer.

4. The laundry treating apparatus of claim 2, further comprising:

a fourth weight balancer disposed on a second portion of the rear cover portion of the tub, the second portion of the rear cover portion being located vertically above the rotational axis, wherein the fourth weight balancer is configured to be asymmetric with respect to the vertical plane.

5. The laundry treating apparatus of claim 4, wherein the fourth weight balancer includes a third balancer portion extending from the vertical plane toward the first side, and a fourth balancer portion extending from the vertical plane toward the second side, the third balancer portion of the fourth weight balancer configured to be heavier than the fourth balancer portion of the fourth weight balancer.

6. The laundry treating apparatus of claim 1, wherein the first weight balancer is separate from the second weight balancer and does not extend to the second side.

7. The laundry treating apparatus of claim 6, wherein the second weight balancer does not extend to the first side.

8. The laundry treating apparatus of claim 1, further comprising:

a controller configured to, based on a revolutions per minute (RPM) set for the drum being greater than a preset reference RPM, control the drum driver to rotate the drum in a rotational direction in which the drum is rotated from the second side toward the first side below the rotational axis.

9. The laundry treating apparatus of claim 8, wherein the reference RPM is set to be equal to or higher than a RPM causing a resonance of the tub.

* * * * *